US007764901B2

(12) United States Patent
Mori et al.

(10) Patent No.: US 7,764,901 B2
(45) Date of Patent: Jul. 27, 2010

(54) DEVELOPING DEVICE, IMAGE CARRIER DEVICE, AND IMAGE FORMING APPARATUS

(75) Inventors: Hiroki Mori, Nagoya (JP); Mitsuru Horinoe, Aichi-ken (JP); Yukiko Nakaya, Konan (JP); Yuichi Matsushita, Nagoya (JP); Fan Xu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 748 days.

(21) Appl. No.: 11/736,034

(22) Filed: Apr. 17, 2007

(65) Prior Publication Data

US 2007/0248376 A1 Oct. 25, 2007

(30) Foreign Application Priority Data

Apr. 21, 2006 (JP) ..... 2006-118184

(51) Int. Cl.
*G03G 15/08* (2006.01)

(52) U.S. Cl. ..... 399/103; 399/102; 399/260; 399/274; 399/279; 399/284

(58) Field of Classification Search ..... 399/102, 399/103, 260, 274, 279, 284
See application file for complete search history.

(56) References Cited

U.S. PATENT DOCUMENTS 5,212,521 A * 5/1993 Ogawa et al. ..... 399/279
5,606,397 A 2/1997 Honda et al.
2005/0158070 A1 7/2005 Ishii
2007/0059031 A1 * 3/2007 Mori et al. ..... 399/103
2007/0264042 A1 * 11/2007 Mori ..... 399/106
2007/0280726 A1 * 12/2007 Ishii ..... 399/103
2008/0056774 A1 3/2008 Mori et al.

FOREIGN PATENT DOCUMENTS

JP 60-051851 3/1985
JP 8-036306 2/1996
JP 2005-189346 7/2005
JP 2005-301115 10/2005
JP 2005-326445 11/2005
JP 2008-058565 3/2008

* cited by examiner

*Primary Examiner*—David M Gray
*Assistant Examiner*—Ryan D Walsh
(74) *Attorney, Agent, or Firm*—Banner & Witcoff, Ltd

(57) ABSTRACT

A layer-thickness regulating member may include a thin plate member and a projection member. The projection member includes a first pressure contact portion that comes into pressure-contact with each of seal areas, a second pressure contact portion that comes into pressure-contact with each of side end areas, and a third pressure contact portion that comes into pressure-contact with a central area. A notched portion is formed at a position of the distal end of the thin plate member where each of the second pressure contact portions is formed, by cutting the thin plate member from an end edge of the distal end toward a downstream side of the rotation direction of the developing agent carrier.

15 Claims, 10 Drawing Sheets

A-A

B-B

F-F

DEVELOPING DEVICE, IMAGE CARRIER DEVICE, AND IMAGE FORMING APPARATUS

CROSS REFERENCE TO RELATED APPLICATION

This application claims priority benefits on the basis of Japanese Patent Application No. 2006-118184 filed on Apr. 21, 2006, the disclosure of which is incorporated herein by reference.

TECHNICAL FIELD

Aspects of the present invention relate to an image forming apparatus such as a laser printer, and to a developing device such as a developer cartridge and to an image carrier device such as a drum cartridge, both being mounted to the image forming apparatus.

BACKGROUND

In some image forming apparatus such as a laser printer, an electrostatic latent image is formed on a surface of a photosensitive drum, and a toner is supplied onto the electrostatic latent image from a developer cartridge, so that a toner image is carried on the surface of the photosensitive drum. The toner image is then transferred onto a sheet, whereby an image is formed on the sheet.

The developer cartridge includes a casing that accommodates a toner and has an opening portion formed towards the photosensitive drum. The casing is provided with a developing roller rotatably provided so as to be exposed from the opening portion, a layer-thickness regulating blade that restricts a layer thickness of the toner carried on the developing roller, and a seal member that prevents the toner from leaking out of the both axial end portions of the developing roller.

For example, there has been proposed some developing device including a toner thin layer-forming blade having a projection made of a silicon rubber elastic body provided over the entire longitudinal width of a distal end of a thin plate spring, in which a first seal member is provided on each of both longitudinal end portions of the developing roller on an upstream side of the rotation direction of the developing roller with respect to the abutting position of the projection against the developing roller.

Further, there has been proposed some developer cartridge which include a leaf-spring member that is arranged in opposed relation to a developing roller and has a layer-thickness regulating blade formed of an insulating silicone rubber at its lower end portion, and a side seal attached to each of both lateral end portions of the leaf-spring member.

However, in the aforementioned developing device, the projection is provided over the entire longitudinal width of the toner thin layer-forming blade. A higher pressure is applied to the both longitudinal end portions of the toner thin layer-forming blade than to the center portion therebetween, so that the both longitudinal end portions thereof are more abraded than the center portion thereof due to rubbing by the projection. As a result, the disadvantage of toner leakage out of the longitudinal end portions thereof is induced.

Furthermore, in the aforementioned developing device described, the first seal member is disposed on the upstream side of the rotation direction of the developing roller with respect to the abutting position of the projection against the developing roller. Therefore, the disadvantage of toner leakage from the portion between the toner thin layer-forming blade and the first seal member is induced.

In the aforementioned developer cartridge, as shown in the representative drawing, both lateral end portions of the leaf-spring member is formed narrower along the rotation direction of the developing roller than the center portion therebetween. This can reduce the pressure applied to the both lateral end portions thereof by the narrowed portion. Further, the side seals are overlapped with and attached to the both lateral end portions of the leaf-spring member. This can suppress toner leakage from the portion between the leaf-spring member and each of the side seals.

However, the aforementioned developer cartridge may still slightly cause the toner leakage from the portion between the leaf-spring member and each of the side seals in some cases.

SUMMARY

One aspect of the present invention may provide a developing device that can effectively prevent the leakage of a developing agent from the portion between a layer-thickness regulating member and a leakage preventing member by a simple construction, and an image carrier device and an image forming apparatus, both equipped with the developing device.

The same or different aspect of the present invention may provide a developing device comprising: a casing that accommodates a developing agent and has an opening portion formed therein extending in a longitudinal direction; a developing agent carrier that is rotatably provided in the casing so as to be exposed from the opening portion and carries the developing agent; a leakage preventing member that is arranged at each of both longitudinal end portions of the casing to prevent the developing agent from leaking out of the casing; and a layer-thickness regulating member that comes into pressure-contact with a surface of the developing agent carrier to form a thin layer of the developing agent on the surface of the developing agent carrier, wherein the developing agent carrier comprises, in a longitudinal direction thereof: a seal area that is rubbed with the leakage preventing member; a side end area adjacent to the seal area on a longitudinal inside of the developing agent carrier; and a central area sandwiched between the side end areas, the layer-thickness regulating member comprises: a thin plate member which is formed in a thin plate-like shape extending along a longitudinal direction of the opening portion, whose downstream end portion of a rotation direction of the developing agent carrier, orthogonal to the longitudinal direction of the opening portion, is fixed to the casing, and whose upstream end portion of the rotation direction of the developing agent carrier is a distal end; and a projection member that is provided at the distal end of the thin plate member and protrudes toward a direction approaching to the developing agent carrier, and the projection member comprises a first pressure contact portion that comes into pressure-contact with the seal area, a second pressure contact portion that comes into pressure-contact with the side end area, and a third pressure contact portion that comes into pressure-contact with the central area, wherein a notched portion is formed at a position of the distal end of the thin plate member where the second pressure contact portion is formed, by cutting the thin plate member from an end edge of the distal end toward a downstream side of the rotation direction of the developing agent carrier.

One or more aspects of the present invention provide an image carrier device comprising: a developing device; and an image carrier that carries a developing agent image formed by feeding a developing agent from the developing device and then developing an electrostatic latent image, wherein the developing device comprises: a casing that accommodates a developing agent and has an opening portion formed therein extending in a longitudinal direction; a developing agent carrier that is rotatably provided in the casing so as to be exposed from the opening portion and carries the developing agent; a leakage preventing member that is arranged at each of both longitudinal end portions of the casing to prevent the developing agent from leaking out of the casing; and a layer-thickness regulating member that comes into pressure-contact with a surface of the developing agent carrier to form a thin layer of the developing agent on the surface of the developing agent carrier, the developing agent carrier comprises, in a longitudinal direction thereof; a seal area that is rubbed with the leakage preventing member; a side end area adjacent to the seal area on a longitudinal inside of the developing agent carrier; and a central area sandwiched between the side end areas, the layer-thickness regulating member comprises: a thin plate member which is formed in a thin plate-like shape extending along a longitudinal direction of the opening portion, whose downstream end portion of a rotation direction of the developing agent carrier, orthogonal to the longitudinal direction of the opening portion, is fixed to the casing, and whose upstream end portion of the rotation direction of the developing agent carrier is a distal end; and a projection member that is provided at the distal end of the thin plate member and protrudes toward a direction approaching to the developing agent carrier, and the projection member comprises a first pressure contact portion that comes into pressure-contact with the seal area, a second pressure contact portion that comes into pressure-contact with the side end area, and a third pressure contact portion that comes into pressure-contact with the central area, wherein a notched portion is formed at a position of the distal end of the thin plate member where the second pressure contact portion is formed, by cutting the thin plate member from an end edge of the distal end toward a downstream side of the rotation direction of the developing agent carrier.

One or more aspects of the present invention provide an image forming apparatus comprising: an image carrier device comprising a developing device, and an image carrier that carries a developing agent image formed by feeding a developing agent from the developing device and then developing an electrostatic latent image; and a fixing unit for fixing the developing agent image onto a recording medium, wherein the developing device comprises: a casing that accommodates a developing agent and has an opening portion formed therein extending in a longitudinal direction; a developing agent carrier that is rotatably provided in the casing so as to be exposed from the opening portion and carries the developing agent; a leakage preventing member that is arranged at each of both longitudinal end portions of the casing to prevent the developing agent from leaking out of the casing; and a layer-thickness regulating member that comes into pressure-contact with a surface of the developing agent carrier to form a thin layer of the developing agent on the surface of the developing agent carrier, the developing agent carrier comprises, in a longitudinal direction thereof; a seal area that is rubbed with the leakage preventing member; a side end area adjacent to the seal area on a longitudinal inside of the developing agent carrier; and a central area sandwiched between the side end areas, the layer-thickness regulating member comprises: a thin plate member which is formed in a thin plate-like shape extending along a longitudinal direction of the opening portion, whose downstream end portion of a rotation direction of the developing agent carrier, orthogonal to the longitudinal direction of the opening portion, is fixed to the casing, and whose upstream end portion of the rotation direction of the developing agent carrier is a distal end; and a projection member that is provided at the distal end of the thin plate member and protrudes toward a direction approaching to the developing agent carrier, and the projection member comprises a first pressure contact portion that comes into pressure-contact with the seal area, a second pressure contact portion that comes into pressure-contact with the side end area, and a third pressure contact portion that comes into pressure-contact with the central area, wherein a notched portion is formed at a position of the distal end of the thin plate member where the second pressure contact portion is formed, by cutting the thin plate member from an end edge of the distal end toward a downstream side of the rotation direction of the developing agent carrier.

One or more aspects of the present invention provide an image forming apparatus comprising: a developing device; an image carrier that carries a developing agent image formed by feeding a developing agent from the developing device and then developing an electrostatic latent image; and a fixing unit for fixing the developing agent image onto a recording medium, wherein the developing device comprises: a casing that accommodates a developing agent and has an opening portion formed therein extending in a longitudinal direction; a developing agent carrier that is rotatably provided in the casing so as to be exposed from the opening portion and carries the developing agent; a leakage preventing member that is arranged at each of both longitudinal end portions of the casing to prevent the developing agent from leaking out of the casing; and a layer-thickness regulating member that comes into pressure-contact with a surface of the developing agent carrier to form a thin layer of the developing agent on the surface of the developing agent carrier, the developing agent carrier comprises, in a longitudinal direction thereof; a seal area that is rubbed with the leakage preventing member; a side end area adjacent to the seal area on a longitudinal inside of the developing agent carrier; and a central area sandwiched between the side end areas, the layer-thickness regulating member comprises: a thin plate member which is formed in a thin plate-like shape extending along a longitudinal direction of the opening portion, whose downstream end portion of a rotation direction of the developing agent carrier, orthogonal to the longitudinal direction of the opening portion, is fixed to the casing, and whose upstream end portion of the rotation direction of the developing agent carrier is a distal end; and a projection member that is provided at the distal end of the thin plate member and protrudes toward a direction approaching to the developing agent carrier, and the projection member comprises a first pressure contact portion that comes into pressure-contact with the seal area, a second pressure contact portion that comes into pressure-contact with the side end area, and a third pressure contact portion that comes into pressure-contact with the central area, wherein a notched portion is formed at a position of the distal end of the thin plate member where the second pressure contact portion is formed, by cutting the thin plate member from an end edge of the distal end toward a downstream side of the rotation direction of the developing agent carrier.

DETAILED DESCRIPTION

Figure 1:
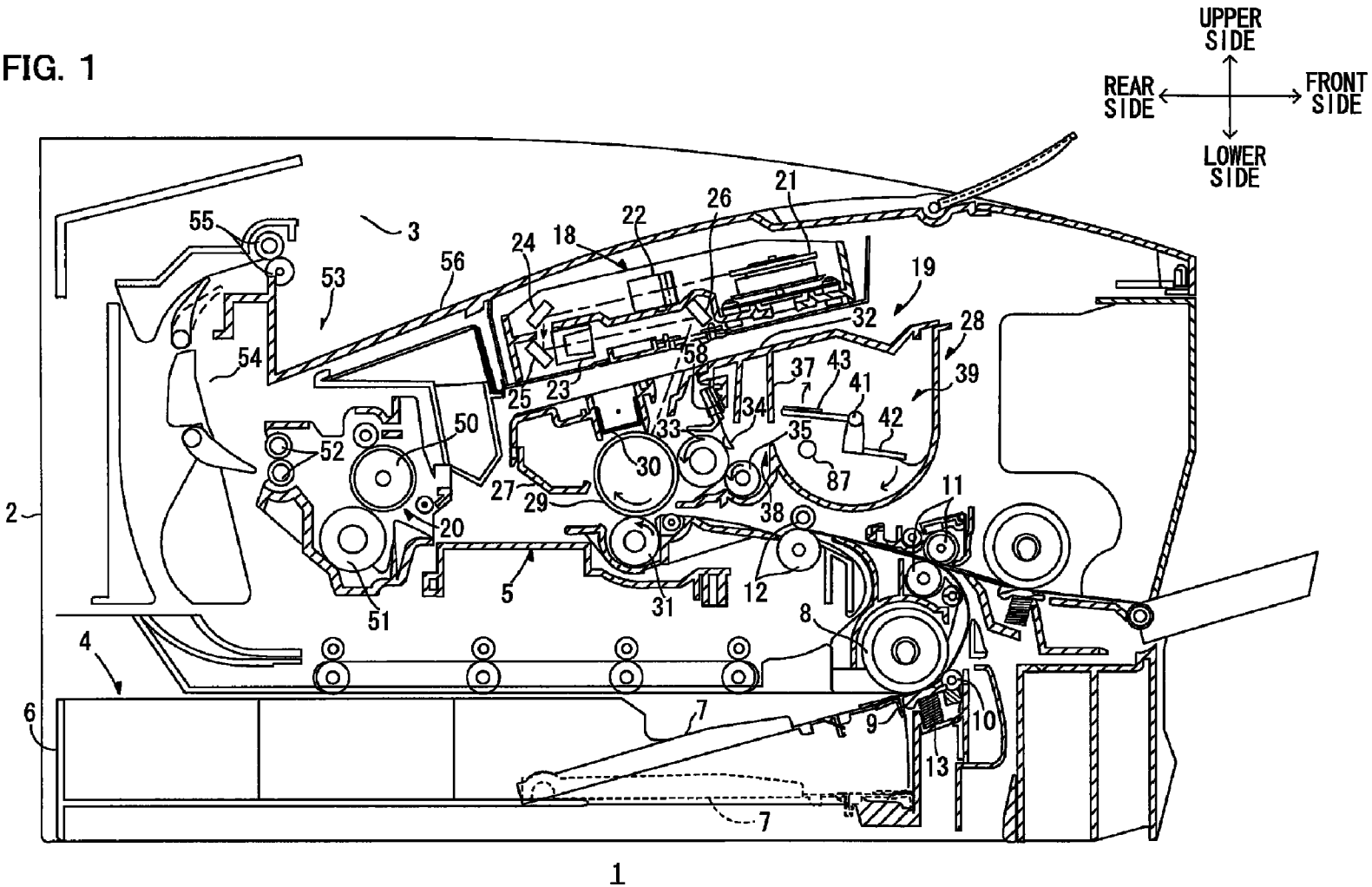
FIG. 1 shows a side sectional view of the major portion of illustrative aspects of a laser printer as an image forming apparatus of one or more aspects of the present invention.
Figure 2:
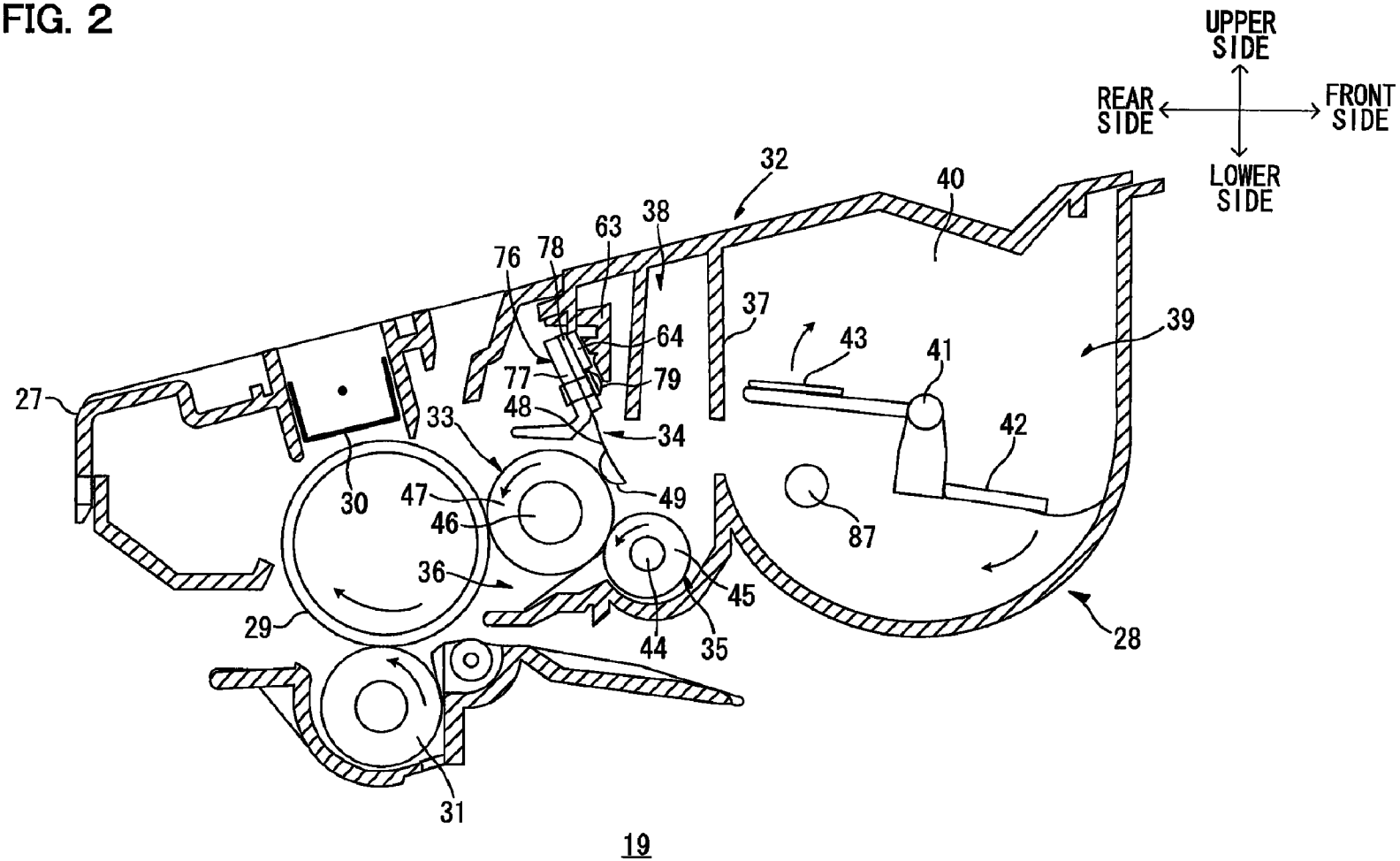
FIG. 2 shows a side sectional view of the major portion of a drum cartridge of the laser printer shown in FIG. 1.

FIG. 1 is a side sectional view of the major portion of one embodiment of a laser printer as an image forming apparatus of one or more aspects of the present invention, and FIG. 2 is a side sectional view of the major portion of a drum cartridge of the laser printer shown in FIG. 1. First, the general structure of the laser printer will be described with reference to FIGS. 1 and 2.

In the following description, in the laser printer 1, the side on which a sheet feeding roller 8 is provided will be referred to as "the front side", while the side on which a sheet ejecting roller 55 is provided will be referred to as "the rear side." Further, in the descriptions of a drum cartridge 27 and a developer cartridge 28, "the front side" and "the rear side" will be also referred to based on the aforementioned sides.

1. General Structure of the Laser Printer

In FIG. 1, the laser printer 1 includes in a main body casing 2 a sheet feeding section 4 for feeding a sheet 3 as a recording medium, an image forming section 5 for forming an image on the sheet 3 thus fed, and a sheet ejecting section 53 for ejecting the sheet 3 with the image thus formed thereon in the image forming section 5, from the main body casing 2.

1-1. Sheet Feeding Section

The sheet feeding section 4 includes a sheet feeding tray 6 anteroposteriorly detachably attached to the bottom portion of the main body casing 2, a sheet pressing plate 7 provided in the sheet feeding tray 6, a sheet feeding roller 8 and a sheet feeding pad 9 both of which are provided above the front end portion of the sheet feeding tray 6, sheet dust removing rollers 10 and 11 each provided in front of and above the sheet feeding roller 8 and on the downstream side in the transport direction of the sheet 3, and a resist roller 12 provided in back of the sheet dust removing roller 11 and on the downstream side in the transport direction of the sheet 3.

The topmost sheet 3 stacked on the sheet pressing plate 7 is pressed toward the sheet feeding roller 8 from the underside of the sheet pressing plate 7 by the spring (not shown), and is then sandwiched between the sheet feeding roller 8 and the sheet feeding pad 9 through the rotation of the sheet feeding roller 8. Thereafter, the sheet 3 thus sandwiched is fed one by one.

Sheet dust is removed from the sheet 3 thus fed by the sheet dust removing rollers 10 and 11, and thereafter, the sheet 3 is transported to the resist roller 12. The resist roller 12 includes a pair of rollers. After the registration of the sheet 3, the resist roller 12 transports the sheet 3 to a transfer position (between a photosensitive drum 29 and a transfer roller 31 each described later) in the image forming section 5.

1-2. Image Forming Section

The image forming section 5 includes a scanning unit 18, a processing unit 19 serving as an image carrier device, a fixing section 20 serving as a fixing unit, and the like.

1-2-1. Scanning Unit

The scanning unit 18 is provided in the upper portion of the main body casing 2, and includes a laser emitting portion (not shown), a polygonal mirror 21 to be rotationally driven, lenses 22 and 23, and reflecting mirrors 24, 25, and 26.

A laser beam discharged from the laser emitting portion based on image data passes through or are reflected by the polygonal mirror 21, the lens 22, the reflecting mirrors 24 and 25, the lens 23 and the reflecting mirror 26 in this order, as shown by a broken chain line, and is then irradiated onto the surface of the photosensitive drum 29 described later in the processing unit 19 by high-speed scanning.

1-2-2. Processing Unit

The processing unit 19 is provided below the scanning unit 18 in the main body casing 2 so as to be detachably attachable to the main body casing 2.

As shown in FIG. 2, the processing unit 19 includes the drum cartridge 27 detachably attached to the main body casing 2, and also includes the developer cartridge 28 serving as a developing device, the photosensitive drum 29 serving as an image carrier, a scorotron charger 30 and the transfer roller 31 which are provided in the drum cartridge 27.

1-2-2-1. Developer Cartridge

The developer cartridge 28 is detachably attached to the drum cartridge 27, and includes a casing 32, and also includes a developing roller 33 serving as a developer carrier, a layer-thickness regulating blade 34 serving as a layer-thickness regulating member and a feed roller 35 which are provided in the casing 32.

The casing 32 has a box-like shape in which an opening 36 extending in a width (lateral) direction (direction orthogonal to a front and rear direction and to an up and down direction) is formed on the rear side thereof, and a partition plate 37 that divides the inside of the casing 32 is formed midway in the front and rear direction thereof. The partition plate 37 divides the inside of the casing 32 into a developing chamber 38 on the rear side and a toner accommodation chamber 39 on the front side. The partition plate 37 is formed so as to be open therebelow, so that the developing chamber 38 and the toner accommodation chamber 39 communicate with each other.

The casing 32 is provided with windows 87 for detecting the remaining amount of toner, on the front sides of both side walls 40, respectively, that are spaced apart in opposed relation in the width direction. The windows 87 are opposed to each other with the toner accommodation chamber 39 interposed therebetween.

The toner accommodation chamber 39 accommodates a positively-chargeable, non-magnetic, single-component toner as a developing agent.

The toner accommodation chamber 39 is provided in its center as viewed in side with a rotating shaft 41 extended between the both side walls 40 along the width direction. The rotating shaft 41 is provided with an agitator 42 for agitating the toner in the toner accommodation chamber 39, and a cleaner 43 for cleaning the windows 87, both extending radially.

When the rotating shaft 41 rotates in the arrow direction (clockwise direction), the toner in the toner accommodation chamber 39 is agitated with the agitator 42 supported by the rotating shaft 41, and is discharged from the open port below the partition plate 37 to the developing chamber 38. The rotation of the rotating shaft 41 moves the cleaner 43 to clean the windows 87.

The feed roller 35 is arranged obliquely rearward below the open port below the partition plate 37 in the developing chamber 38. The feed roller 35 includes a metal roller shaft 44, and a sponge roller 45 made of a conductive sponge material that covers the roller shaft 44.

The both end portions of the roller shaft 44 of the feed roller 35 are rotatably supported on the both side walls 40 of the casing 32, whereby the feed roller 35 is provided rotatably in the arrow direction (counterclockwise direction).

The developing roller 33 is arranged in the developing chamber 38 so as to be opposed to the feed roller 35 obliquely rearward and upward, and to be exposed from the opening 36 of the casing 32. The developing roller 33 includes a metal roller shaft 46, and a rubber roller 47 made of a conductive rubber material that covers the roller shaft 46.

The both end portions of the roller shaft 46 of the developing roller 33 are rotatably supported on the both side walls 40 of the casing 32, whereby the developing roller 33 is provided rotatably in the arrow direction (counterclockwise direction). A developing bias is applied to the developing roller 33 during a developing operation.

The feed roller 35 and the developing roller 33 are in abutment against each other so as to be compressed to some extent.

The layer-thickness regulating blade 34 is arranged forward above the developing roller 33, in the developing chamber 38. The layer-thickness regulating blade 34 includes a leaf spring member 48 as a flexible thin plate member formed in a thin plate-like shape, and a pressure contact portion 49 as a projection member provided at the lower end portion of the leaf spring member 48, as will be described in greater detail later.

Figure 7:
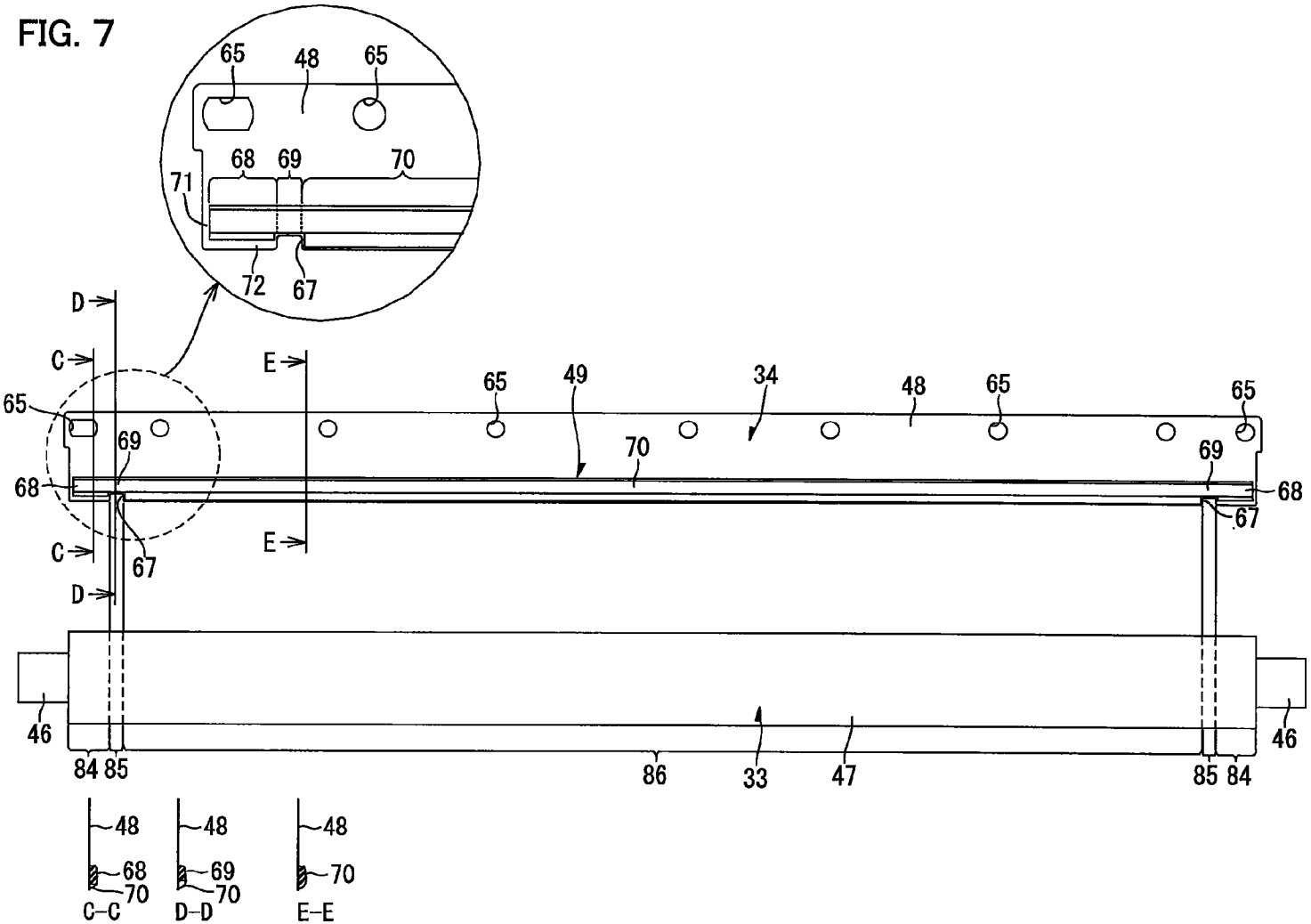
FIG. 7 shows a rear view of a layer-thickness regulating blade shown in FIG. 4.

The leaf spring member 48 is made of a metal thin plate, and is formed in a generally elongated rectangular shape in rear view, extending along a width direction thereof (see FIG. 7). The upper end portion (downstream end portion of the developing roller 33) of the leaf spring member 48 is fixed to the upper side of the opening 36 of the casing 32 by a mounting member 76 so that the lower end portion (upstream end portion of the developing roller 33) thereof is a distal end, as will be described in greater detail later.

The pressure contact portion 49 is made of rubber such as silicone rubber, and is formed continuously with the lower end portion of the leaf spring member 48 in the width direction. The pressure contact portion 49 protrudes rearward from the leaf spring member 48 so as to be adjacent to the developing roller 33.

In the layer-thickness regulating blade 34, due to an elastic force of the leaf spring member 48 with its upper end portion being fixed, the pressure contact portion 49 provided in its lower end portion presses the surface of the developing roller 33 obliquely from the upper front side.

In response to the rotation of the feed roller 35, the toner discharged from the open port below the partition plate 37 is fed to the developing roller 33. At this time, the toner is triboelectrically charged with a positive polarity between the feed roller 35 and the developing roller 33. Subsequently, as the developing roller 33 rotates, the toner thus fed on the developing roller 33 enters between the pressure contact portion 49 of the layer-thickness regulating blade 34 and the developing roller 33. While a layer thickness of the toner is regulated therebetween, the toner is carried on the surface of the developing roller 33 as a thin layer.

1-2-2-2. Drum Cartridge

In the drum cartridge 27, the developer cartridge 28 is detachably attached, and the photosensitive drum 29, the scorotron charger 30 and the transfer roller 31 are provided.

The photosensitive drum 29 is arranged behind the developing roller 33 in opposed relation thereto, and is provided rotatably in the arrow direction (clockwise direction). The photosensitive drum 29 is grounded, and the outermost surface layer thereof is formed of a positively chargeable photosensitive layer of polycarbonate etc.

The scorotron charger 30 is provided above the photosensitive drum 29 in a spaced relation thereto. The scorotron charger 30 is a positive scorotron charger designed for generating a corona discharge from a wire made of tungsten etc., and uniformly charges the surface of the photosensitive drum 29 with a positive polarity.

Along with the rotation of the photosensitive drum 29, the surface of the photosensitive drum 29 is uniformly positively charged by the scorotron charger 30, and then exposed to the laser beams emitted from the scanning unit 18 by high-speed scanning, whereby an electrostatic latent image corresponding to the image data is formed thereon.

Subsequently, in response to the rotation of the developing roller 33, the toner carried on the surface of the developing roller 33 contacts the photosensitive drum 29 in opposed relation. At this time, the toner is fed onto the electrostatic latent image formed on the photosensitive drum 29, that is, an exposed portion, in which the potential is lowered due to exposure to the laser beams, of the surface of the photosensitive drum 29 uniformly positively charged, and is then selectively carried on its surface to form a visible image. This realizes reverse development, so that a toner image as a developing agent image is carried on the surface of the photosensitive drum 29.

The transfer roller 31 is arranged below the photosensitive drum 29 in opposed relation thereto, and is provided rotatably in the arrow direction (counterclockwise direction). The transfer roller 31 includes a metal roller shaft, and a rubber roller made of a conductive rubber material that covers the roller shaft. A transfer bias is applied to the transfer roller 31 during a transfer operation.

Then, the toner image thus carried on the surface of the photosensitive drum 29 is transferred onto the sheet 3 while the sheet 3 transported from the resist roller 12 passes through a position (transfer position) between the photosensitive drum 29 and the transfer roller 31.

1-2-3. Fixing Section

As shown in FIG. 1, the fixing section 20 is provided on the rear side of the processing unit 19, and downstream in the transport direction of the sheet 3. The fixing section 20 includes a heating roller 50, a pressure roller 51, and a pair of transport rollers 52.

In the fixing section 20, the toner transferred onto the sheet 3 in the transfer position is thermally fixed thereon while the sheet 3 passes through between the heating roller 50 and the pressure roller 51, and thereafter, the resulting sheet 3 is transported to the sheet ejecting section 53 by the pair of transport rollers 52.

1-3. Sheet Ejecting Section

The sheet ejecting section 53 includes a sheet ejecting path 54, the sheet ejecting roller 55 provided at the downstream end portion of the sheet ejecting path 54, and a sheet ejection tray 56 that receives the sheet 3 ejected from the sheet ejecting roller 55.

The sheet 3 transported from the fixing section 20 to the sheet ejecting path 54 is then transported therefrom to the sheet ejecting roller 55, and is ejected onto the sheet ejection tray 56 by the sheet ejecting roller 55.

2. Structure of the Major Portion of the Developer Cartridge

Figure 3:
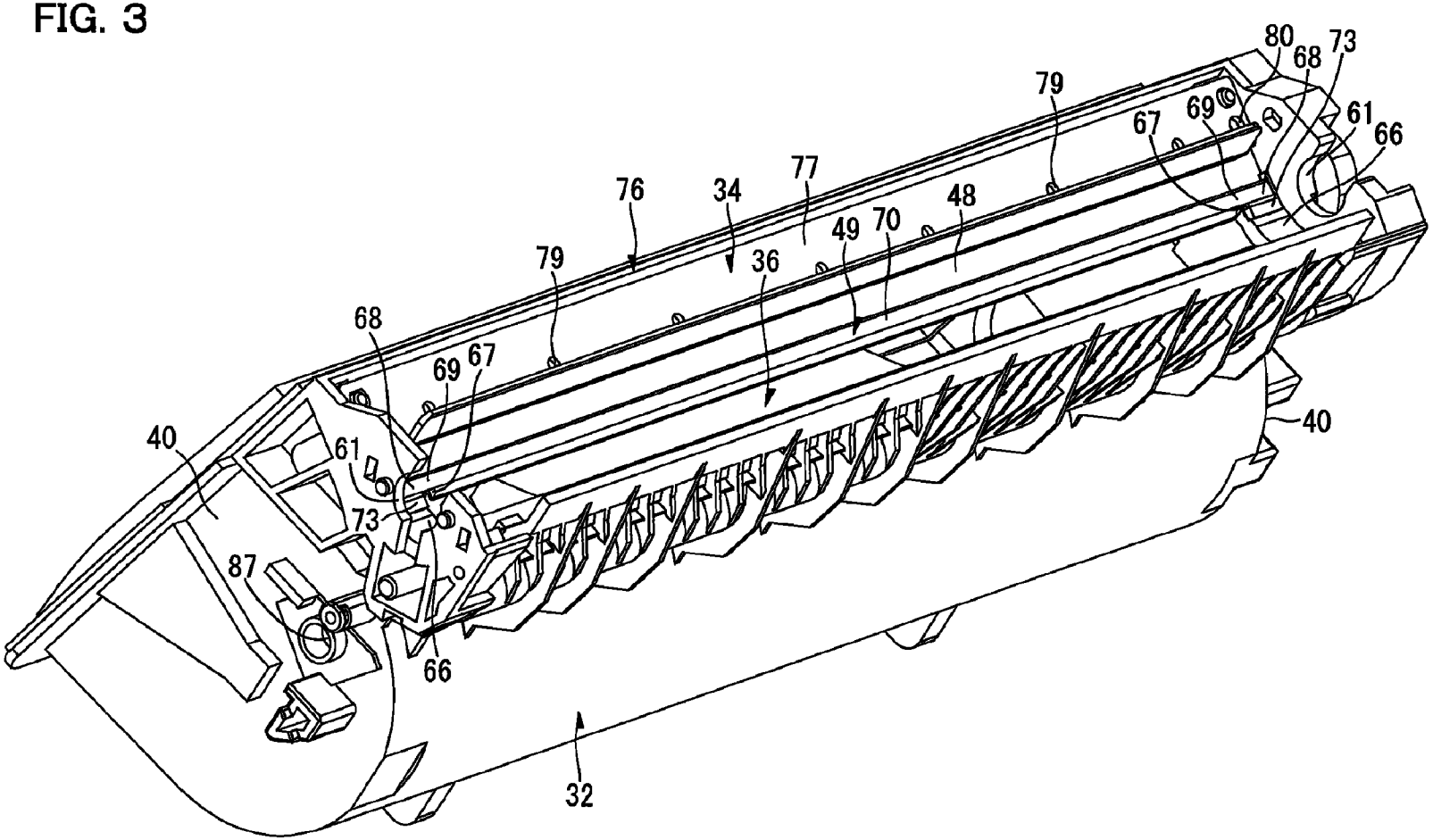
FIG. 3 shows a perspective view of a developer cartridge seen from the rear of a casing.
Figure 4:
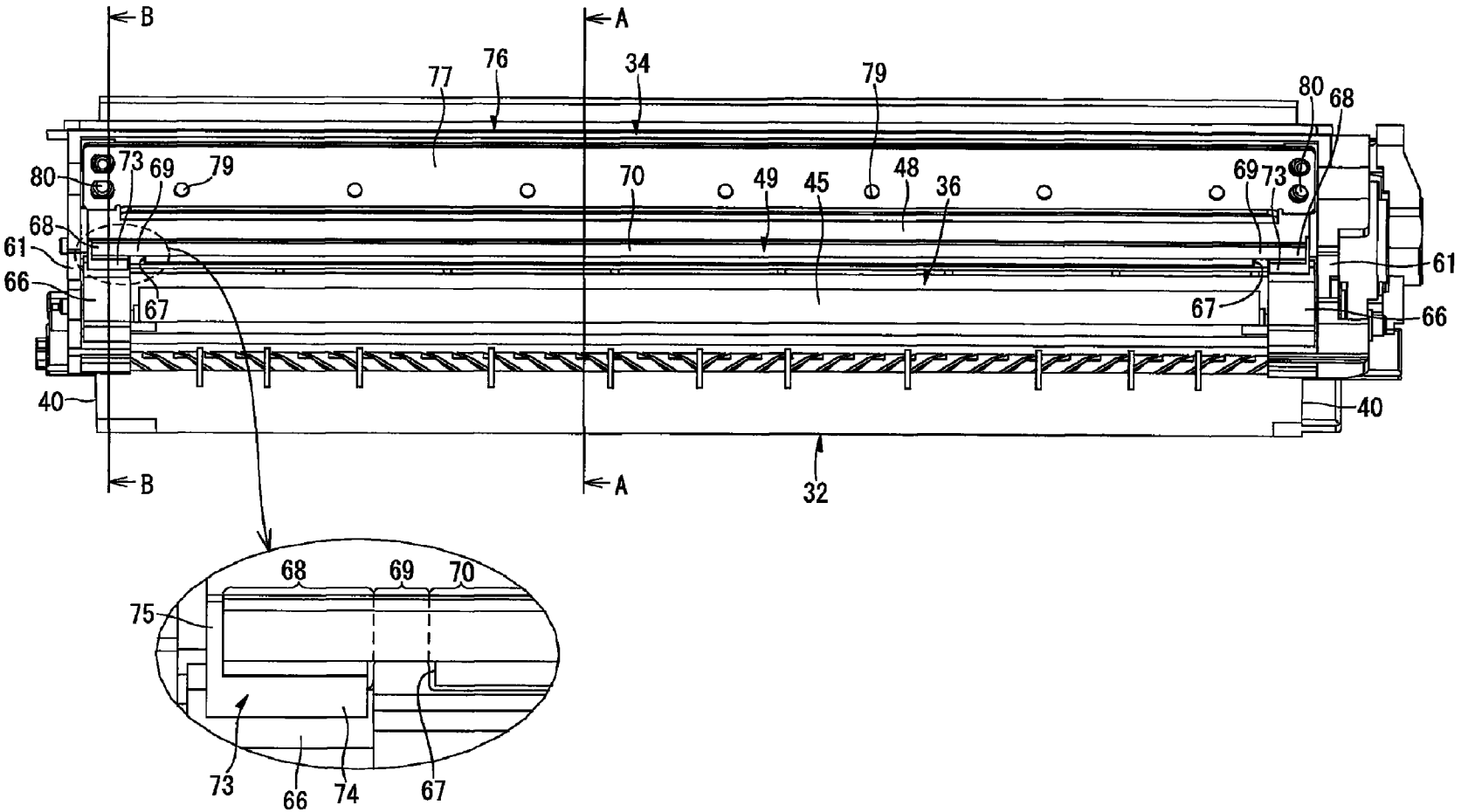
FIG. 4 shows a rear view of the casing shown in FIG. 3.
Figure 5:
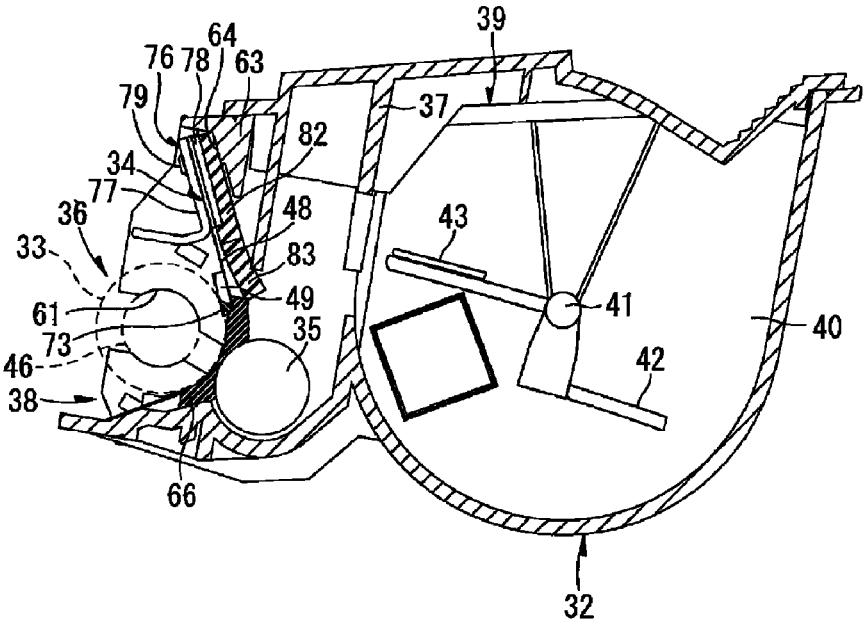
FIG. 5 shows a sectional view taken along the line A-A in FIG. 4.
Figure 6:
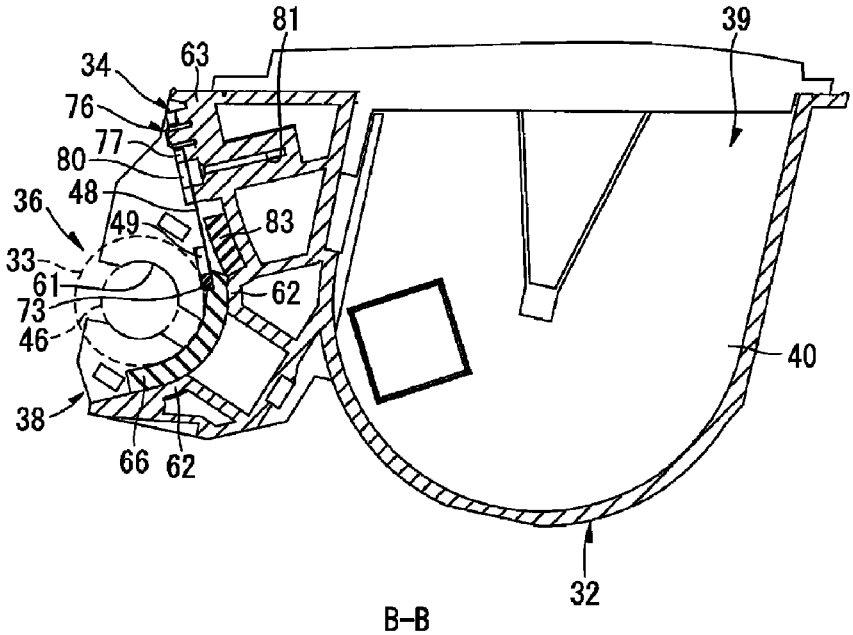
FIG. 6 shows a sectional view taken along the line B-B in FIG. 4.

FIG. 3 shows a perspective view of the developer cartridge seen from the rear of the casing, FIG. 4 shows a rear view of the casing shown in FIG. 3, FIG. 5 shows a sectional view taken along the line A-A in FIG. 4, FIG. 6 shows a sectional view taken along the line B-B in FIG. 4, and FIG. 7 shows a rear view of the layer-thickness regulating blade shown in FIG. 4. In the following, the structure of the major portion of the developer cartridge 28 will be described with reference to FIGS. 3 through 7.

2-1. Casing

The casing 32 of the developer cartridge 28 is formed in a box-like shape with the opening 36 extending in the width direction (longitudinal direction of the casing 32) on its rear side as described above.

As shown in FIGS. 3 and 6, the casing 32 has shaft support grooves 61 in both side walls 40 that sandwich the opening 36 in the width direction, and each shaft support groove 61 is formed by cutting away a portion of the side wall 40 forward from its rear end edge.

Seal pedestal portions 62 are provided on the front side and the lower side around the respective shaft support grooves 61 in the side walls 40, and each seal pedestal portion 62 (wider than a side seal 66 described later, in a range of, e.g., 8 to 10 mm) protrudes with a given width toward the lateral inside from each side wall 40.

As shown in FIG. 6, the seal pedestal portions 62 are arranged in the respective side walls 40 along the outer circumference of the developing roller 33 in side view, and are divided into a portion on the front side and a portion on the lower side with respect to the shaft support groove 61, and the portions are circumferentially spaced apart from each other.

As shown in FIGS. 5 and 6, the casing 32 is provided with a mounting wall 63 to which the layer-thickness regulating blade 34 is fixed together with the mounting member 76, along the upper edge portion of the opening 36. The mounting wall 63 is provided in the upper end edge portion of the opening 36 along the width direction, and as shown in FIG. 5, its rear surface 64 is formed so as to incline from the upper rear side to the lower front side. As shown in FIG. 6, a threaded hole 81 into which a fixing screw 80 described later is screwed is provided in each lateral end portion of the mounting wall 63.

2-2. Side Seal

As shown in FIGS. 4 and 6, the casing 32 is provided with a side seal 66 on each of the both axial (longitudinal) end portions of the developing roller 33. The side seal 66 serves as a first seal member of leakage preventing members for preventing a toner carried on the developing roller 33 from leaking out of the casing 32 from the both axial end portions of the developing roller 33 that rotates during a developing operation.

The side seal 66 has a generally elongated rectangular shape in rear view extending in the rotation direction (up and down direction) of the developing roller 33, and is formed in a sheet-like shape having a given thickness (e.g., 2 to 3 mm). The side seal 66 is made of an elastic foam material such as a urethane sponge. More specifically, the side seal 66 is made of a high-density, microcellular urethane foam (trade name: PORON, manufactured by Rogers-INOAC Corporation) which has a comparatively high rigidity and resists permanent deformation among urethane sponges. The high-density, microcellular urethane foam has a hardness in the range of 0.001 to 0.05 MPa under 25% compressive load, more preferably 0.005 to 0.025 MPa. A felt material made of Teflon™ felt, etc. is attached to the elastic foam material surface (opposite surface to the developing roller 33) of each side seal 66 in order to improve sliding property.

The side seal 66 is arranged on an upstream side (lower side) of the rotation direction of the developing roller 33, with respect to the lateral outer portion (opposed portion of the layer-thickness regulating blade 34 to each seal area 84, described later, of the developing roller 33) from the outer end edge of each notched portion 67 (described later) in the leaf-spring member 48 of the layer-thickness regulating blade 34). The side seals 66 are attached via a double-faced adhesive tape, etc to the respective upper surfaces of the seal pedestal portions 62 arranged in opposed relation at an interval in the width direction in the casing 32. More specifically, each of the side seals 66 is attached over the upper surface of the front portion and the upper surface of the lower portion in the seal pedestal portion 62. The front and lower portions are separately formed so as to be circumferentially spaced apart from each other.

2-3. Layer-Thickness Regulating Blade

As shown in FIG. 7 and as described above, the layer-thickness regulating blade 34 includes the leaf spring member 48 that is made of a metal thin plate and is formed in a generally elongated rectangular shape in rear view extending along a width direction thereof, and the pressure contact portion 49 that is made of a silicone rubber and is provided in the lower end portion of the leaf-spring member 48.

2-3-1. Leaf Spring Member

The leaf-spring member 48 has a plurality of screw holes 65 bored in its upper end portion. The screw holes 65 therein are provided at spaced intervals to one another in the width direction.

Further, the leaf-spring member 48 has, in its lower end portion, notched portions 67 formed near the both lateral end portions. As shown in FIG. 4, each notched portion 67 is arranged adjacent to the lateral inside of each side seal 66.

Each notched portion 67 is formed in a generally recessed shape such that the leaf-spring member 48 is cut from its lower end edge toward a downstream side (upper side) of the rotation direction of the developing roller 33 so that an upstream side (lower side) of the rotation direction of the developing roller 33 is open.

More specifically, each notched portion 67 is formed in a generally rectangular shape in rear view such that its outer end edge is adjacent to the side seal 66, its inner end edge is spaced at a given interval (e.g., 2 to 4 mm) inward in the width direction from the outer end edge, and the outer and inner end edges are opposed in parallel to each other over a given length (e.g., 1 to 2 mm) from the end edge of the lower end portion of the leaf-spring member 48 toward a downstream side (upper side) of the rotation direction of the developing roller 33.

2-3-2. Pressure Contact Portion

As described above, the pressure contact portion 49 is made of elastic rubber such as silicone rubber, and is formed in a ridge shape extending in the width direction and protruding rearward at the lower end portion of the leaf-spring member 48.

As shown in FIG. 7, the pressure contact portion 49 includes, in the width direction, a first pressure contact portion 68 provided on the lateral outside of the outer end edge of the notched portion 67, a second pressure contact portion 69 that is continuously adjacent to the first pressure contact portion 68 in the width direction and is overlapped with the notched portion 67 on the downstream side (upper side) of the rotation direction of the developing roller 33, and a third pressure contact portion 70 that is continuously adjacent to the second pressure contact portion 69 in the width direction and is sandwiched between the second pressure contact portions 69.

The first pressure contact portion 68 is arranged in the lateral outer portion of the notched portion 67 continuously from the outer end edge of the notched portion 67 in the lower end portion of the leaf-spring member 48, so that the lateral outer end edge portion and the lower end edge of the leaf-spring member 48 are exposed, and is formed in a generally rectangular shape in rear view. As shown in a sectional view taken along the line C-C in FIG. 7, the sectional shape of the first pressure contact portion 68 in the up and down direction (rotation direction of the developing roller 33) is a generally elongated rectangular shape with its corners curved.

In addition, on the lateral outside (longitudinal outside) of the first pressure contact portion 68, the lateral outer end edge portion of the leaf-spring member 48 exposed from the first pressure contact portion 68 is defined as a lateral sticked portion 71 that is a side end exposing area to which a longitudinal band area 75 of a blade seal 73 described later is attached. On the lower side (upstream side of the rotation direction of the developing roller 33) of the first pressure contact portion 68, the lower end edge portion of the leaf-spring member 48 exposed from the first pressure contact portion 68 is defined as a lower-side sticked portion 72 that is an upstream end exposing area to which a lateral band area 74 of the blade seal 73 described later is attached.

The second pressure contact portions 69 is arranged in an upper portion of the notched portion 67 continuous from the upper end edge thereof (end edge in the deepest portion of the notched portion 67) in the lower end portion of the leaf-spring member 48, corresponding to the positions where the notched portion 67 is formed, and is formed in a generally rectangular shape in rear view. As shown in a sectional view taken along the line D-D in FIG. 7, the second pressure contact portion 69 is formed such that the sectional shape thereof along the up and down direction is a generally elongated rectangular shape with its corners curved, and the up-to-down length (length along the rotation direction of the developing roller 33) thereof is shorter than that of the first pressure contact portion 68.

The third pressure contact portion 70 is arranged in a portion in the lower end portion of the leaf-spring member 48, the portion being sandwiched between the second pressure contact portions 69 that are continuous from the inner end edges of the respective notched portions 67, and is formed in a generally elongated rectangular shape in rear view extending in the width direction. As shown in a sectional view taken along the line E-E in FIG. 7, the third pressure contact portion 70 is formed such that the sectional shape thereof along the up and down direction is a generally elongated rectangular shape with its corners curved and its lower end portion slightly expanding forward, and the up-to-down length (length along the rotation direction of the developing roller 33) thereof is longer than that of the first pressure contact portion 68.

In the pressure contact portion 49, the first pressure contact portions 68, the second pressure contact portions 69 and the third pressure contact portion 70 are formed continuously along the width direction (longitudinal direction of the leaf-spring member 48).

The upper end edges of the first pressure contact portions 68, second pressure contact portions 69 and third pressure contact portion 70 are aligned along the width direction (longitudinal direction of the leaf-spring member 48), at positions spaced at a given interval (e.g., 0.1 to 0.3 mm) upward (to the downstream side of the rotation direction of the developing roller 33) from the upper end edges of the notched portions 67 in the leaf-spring member 48. That is, the upper end edges of those first, second and third pressure contact portions 68, 69, 70 are flush with one another.

On the other hand, the lower end edge of the first pressure contact portion 68 is formed upward from the lower end edge of the leaf-spring member 48 at a position spaced by the lower-side sticked portion 72. The lower end edge of the second pressure contact portion 69 is formed continuously with the upper end edge of the notched portion 67 in the leaf-spring member 48, and the lower end edge of the third pressure contact portion 70 is formed continuously with the lower end edge of the leaf-spring member 48.

That is, with respect to the lower end edge of the first pressure contact portion 68, the lower end edge of the second pressure contact portion 69 is arranged on an upper side (downstream side of the rotation direction of the developing roller 33), and the lower end edge of the third pressure contact portion 70 is arranged on a lower side (upstream side of the rotation direction of the developing roller 33). Therefore, the first pressure contact portion 68, the second pressure contact portion 69 and the third pressure contact portion 70 have different sectional shapes along the up and down direction.

The pressure contact portion 49 is provided so as to surround each notched portion 67. More specifically, the second pressure contact portion 69 is formed continuously with the upper end edge of the notched portion 67, the first pressure contact portion 68 is formed continuously from the lateral outer end edge of the second pressure contact portion 69 so as to surround the notched portion 67, and the third pressure contact portion 70 is formed continuously from the lateral inner edge of second pressure contact portion 69 so as to surround the notched portion 67.

2-3-3. Blade Seal

As shown in FIGS. 4 and 6, the layer-thickness regulating blade 34 includes the blade seal 73 as a second seal member of the leakage preventing members provided on each of the both lateral end portions of the leaf-spring member 48.

The blade seal 73 is formed in an L-shape in rear view, and made of an elastic foam material such as a urethane sponge similar to that in the aforementioned side seal 66. Further, a felt material similar to that in the aforementioned side seal 66 is attached to the surface of the elastic foam material (opposed surface to the developing roller 33). More specifically, the blade seal 73 integrally includes the lateral band area 74 that extends in the width direction, and the longitudinal band area 75 that extends upward (to the downstream side of the rotation direction of the developing roller 33) from a lateral outer end portion of the lateral band area 74. The blade seal 73 is formed with a given thickness (e.g., 1.5 to 2.0 mm) thinner than the thickness of the side seal 66.

The blade seals 73 are respectively attached to the both lateral end portions of the leaf-spring member 48. More specifically, in the lateral outer portion (opposed portion of the layer-thickness regulating blade 34 to the seal area 84, described later, of the developing roller 33) from the outer end edge of the notched portion 67 in the leaf-spring member 48, the lateral band area 74 is attached to the lower-side sticked portion 72 via a double-faced adhesive tape, etc. so as to abut against the entire width of the lower end edge of the first pressure contact portion 68 in the width direction (longitudinal direction of the leaf-spring member 48) without a gap, and the longitudinal band area 75 is attached to the lateral sticked portion 71 via a double-faced adhesive tape, etc. so as to abut against the lateral outer end edge of the first pressure contact portion 68 without a gap.

2-3-4. Mounting of the Layer-thickness Regulating Blade

As shown in FIGS. 4 and 6, the layer-thickness regulating blade 34 is mounted to the casing 32 via the mounting member 76.

As shown in FIGS. 4 and 5, the mounting member 76 includes a front support member 77 comprising a steel sheet in a generally L-shape as viewed in section extending in the width direction, and a back support member 78 comprising a steel sheet in a flat plate-like shape extending in the width direction.

The back support member 78 is formed such that a lateral length thereof is shorter than that of the front support member 77.

The layer-thickness regulating blade 34 is attached to the mounting member 76 by pinching the upper portion of the leaf-spring member 48 between the front support member 77 and the back support member 78. More specifically, the leaf-spring member 48 is pinched between the front support member 77 and the back support member 78, and as shown in FIG. 2, a plurality of screws 79 are inserted through the respective screw holes 65 (except screw holes 65 in the both lateral end portions) in the leaf-spring member 48 from the back support member 78 and then fixed to the front support member 77, so that the leaf-spring member 48 is fixed between the front support member 77 and the back support member 78.

On the other hand, as shown in FIG. 5, a blade back upper seal 82 is provided on the mounting wall 63 of the casing 32. The blade back upper seal 82 is made of an elastic foam material such as a urethane sponge, and is formed in a generally elongated rectangular shape in rear view having a longer up-to-down length than the mounting wall 63 and extending in the width direction.

The blade back upper seal 82 is attached to the rear surface 64 of the mounting wall 63 between the threaded holes 81 in the both lateral end portions of the mounting wall 63 via a double-faced adhesive tape, etc. so that a generally lower half portion of the blade back upper seal 82 extends off the mounting wall 63.

Further, as shown in FIG. 6, a blade back side seal 83 made of an elastic foam material, such as a urethane sponge, is attached to the rear end surface of the casing 32 below the lateral end portion of the mounting wall 63 and above the seal pedestal portions 62, via a double-faced adhesive tape, etc.

The mounting member 76 that pinches the layer-thickness regulating blade 34 is arranged so that the back support member 78 is opposed to the blade back upper seal 82 between the both lateral end portions of the mounting wall 63 as shown in FIG. 5, and the lateral end portion of the front support member 77 is opposed to the threaded hole 81 in the mounting wall 63 at the lateral end portion of the mounting wall 63, and the lateral end portion of the leaf-spring member 48 is opposed to the blade back side seal 83, as shown in FIG. 6. The mounting member 76 is then attached to the mounting wall 63 together with the layer-thickness regulating blade 34 by the fixing screws 80 that are inserted through the screw holes 65 of the both lateral end portions of the leaf-spring member 48 from the both lateral end portions of the front support member 77 and then screwed into the respective threaded holes 81, as shown in FIG. 6.

In the layer-thickness regulating blade 34 thus attached, the blade seal 73 is arranged adjacent to the side seal 66 on the downstream side (upper side) of the rotation direction of the developing roller 33 so that the leaf-spring member 48 inclines from the upper rear side to the lower front side along the rear surface 64, the lower end portion of the leaf-spring member 48 is placed on the upper end portion of the side seal 66 at each of the both lateral end portions thereof, and the lower end portion (upstream end portion of the developing roller 33) of the blade seal 73 and the upper end portion (downstream end portion of the developing roller 33) of the side seal 66 overlap each other in their thickness direction.

2-4. Developing Roller

As indicated by a phantom line in FIG. 5, the both axial end portions of the roller shaft 46 of the developing roller 33 are received in the respective axial support ends 61 formed in the both side walls 40 of the casing 32, whereby the developing roller 33 is rotatably supported on the both side walls 40 of the casing 32.

As shown in FIG. 7, in the developing roller 33 thus supported, the rubber roller 47 thereof is divided, in the width direction, into the seal areas 84 that are rubbed by the respective side seals 66 and blade seals 73, side end areas 85 that are adjacent to the respective seal areas 84 on the lateral insides and are arranged in opposed relation to the respective notched portions 67 of the leaf-spring member 48, and a central area 86 sandwiched between the side end areas 85.

In the pressure contact portion 49 of the layer-thickness regulating blade 34, the first pressure contact portions 68 are in pressure contact with the respective seal areas 84, the second pressure contact portions 69 are in pressure contact with the respective side end areas 85, and the third pressure contact portion 70 is in pressure contact with the central area 86.

3. Operations and Effects of Embodiments (1) As described above, in the developer cartridge 28, the pressure contact portion 49 is provided at the lower end portion of the leaf-spring member 48 of the layer-thickness regulating blade 34 along the width direction, and the notched portions 67 are respectively formed at positions where the second pressure contact portions 69 are formed. Therefore, the notched portions 67 can reduce the pressure on the second pressure contact portions 69, i.e., reaction force produced when the second pressure contact portions 69 press the respective side end areas 85. As a result, the difference between the pressures of the layer-thickness regulating blade 34 on the side end areas 85 and the central area 86 of the developing roller 33 can be reduced, thereby reducing the damages of the second pressure contact portions 69 due to the rubbing. Therefore, the leakage of the toner from the side end areas 85 of the developing roller 33 can be effectively prevented.

Moreover, the layer-thickness regulating blade 34 is provided with the first pressure contact portions 68 that come into pressure contact with the respective seal areas 84 of the developing roller 33. Therefore, even if the toner is stagnated at the notched portions 69, the first pressure contact portions 68 can block the movement of the stagnated toner outward in the width direction. Thus, the leakage of the toner from the side end areas 85 of the developing roller 33 can be more effectively prevented.

As a result, the leakage of the toner from the portion between the layer-thickness regulating blade 34 and each of the blade seals 73 can be effectively prevented by a simple construction.

(2) Further, in the layer-thickness regulating blade 34, the second pressure contact portion 69 and the first pressure contact portion 68 are provided continuously from the upper end edge of the notched portion 67 to the lateral outer end edge thereof so as to surround the notched portion 67. Therefore, the toner that moves from the portion between the upper end edge of the notched portion 67 and the lateral outer end edge thereof to the portion between the first pressure contact portion 68 and the blade seal 73 can be blocked by the second pressure contact portion 69 and the first pressure contact portion 68. Thus, the leakage of the toner from the portion between the first pressure contact portion 68 and the blade seal 73 can be prevented.

(3) In the layer-thickness regulating blade 34, the first pressure contact portions 68 are formed such that the lateral outer end edge portion and the lower end edge portion of the leaf-spring member 48 are exposed. Therefore, the contact area of the blade seal 73 with the leaf-spring member 48, i.e., the lateral sticked portion 71 and the lower-side sticked portion 72, can be secured, whereby the leakage of the toner can be more highly prevented.

The layer-thickness regulating blade 34 is formed such that the up-to-down length of the first pressure contact portion 68 is longer than that of the second pressure contact portion 69, and shorter than that of the third pressure contact portion 70. Therefore, the effective pressure by the third pressure contact portion 70 on the central area 86 is secured to surely achieve the layer thickness regulation of the toner, and at the same time, the differences among the pressures by the first pressure contact portion 68, the second pressure contact portion 69 and the third pressure contact portion 70 of the layer-thickness regulating blade 34, on the seal area 84, the side end area 85 and the central area 86 of the developing roller 33, respectively, can be reduced. As a result, the damages of the second pressure contact portion 69 due to the rubbing can be reduced, whereby the leakage of the toner from the side end area 85 of the developing roller 33 can be effectively prevented.

(4) In the layer-thickness regulating blade 34, the first pressure contact portions 68, the second pressure contact portions 69 and the third pressure contact portion 70 are formed continuously along the width direction, and the sectional shape of the second pressure contact portions 69 along the up and down direction are different from that of the first pressure contact portions 68 and that of the third pressure contact portion 70 along the up and down direction. Specifically, the sectional shape of the second pressure contact portions 69 is different from that of the first pressure contact portions 68 and that of the third pressure contact portion 70 so that each second pressure contact portion 69 is not continuous with the corresponding first pressure contact portion 68 and the third pressure contact portion 70 at their boundaries, in the width direction.

Therefore, the boundary between the central area 86 pressed by the third pressure contact portion 70 and the side end area 85 pressed by the second pressure contact portion 69 is clarified, and the boundary between the side end area 85 pressed by the second pressure contact portion 69 and the seal area 84 pressed by the first pressure contact portion 68 is also clarified, whereby the amount of toners pressed by the second pressure contact portion 69 can be uniformly reduced. Thus, the leakage of the toner from the portion between the first pressure contact portion 68 and the blade seal 73 can be highly prevented.

(5) Further, the sectional shape of the first pressure contact portions 68 is different from that of the third pressure contact portion 70, so that the pressure by the third pressure contact portion 70 can be increased and the pressure by the first pressure contact portion 68 can be reduced. Therefore, the layer thickness regulation of the toner is surely achieved, and the abrasion of the second pressure contact portion 69 due to the rubbing is reduced, whereby the leakage of the toner from the side end area 85 of the developing roller 33 can be effectively prevented.

(6) In the layer-thickness regulating blade 34, since the notched portion 67 is formed in a generally recessed shape opening downward, the notched portion 67 can be simply formed, and the pressure on the second pressure contact portion 69 can be surely reduced.

(7) The blade seal 73 is arranged at the lateral sticked portion 71 and the lower-side sticked portion 72 of the leaf-spring member 48 so as to abut against the first pressure contact portion 68, thereby surely blocking the toner that moves outward in the width direction from the first pressure contact portions 68. Therefore, the leakage of the toner from the side end area 85 of the developing roller 33 can be more effectively prevented.

(8) Since the developer cartridge 28 is provided with the side seal 66 and the blade seal 73 at each of the both lateral end portions of the opening 36, the side seal 66 prevents the leakage of the toner out of the lower side of the lateral outer portion from the outer end edge of the notched portion 67 in the layer-thickness regulating blade 34, and the blade seal 73 prevents the leakage of the toner out of the lateral sticked portion 71 and the lower-side sticked portion 72 in the widthwise outer portion from the outer end edge of the notched portion 67 in the layer-thickness regulating blade 34. Therefore, the side seal 66 and the blade seal 73 can surely prevent the leakage of the toner to the axial outside of the developing roller 33.

(9) Since the lateral band area 74 of the blade seal 73 is in abutment against the entire width of the lower end edge of the first pressure contact portion 68 without a gap, the toner that moves outward in the width direction along the portion between the first pressure contact portion 68 and the blade seal 73 can be blocked. Therefore, the leakage of the toner out of the developing roller 33 outward in the axial direction can be surely prevented.

(10) Since the lower end portion of the blade seal 73 and the upper end portion of the side seal 66 overlap each other in their thickness direction, the leakage of the toner from the portion between the blade seal 73 and the side seal 66 can be effectively prevented.

(11) Thus, in the processing unit 19 equipped with the developer cartridge 28, and further, in the laser printer 1 equipped with the processing unit 19, the leakage of the toner can be effectively prevented.

4. Variation

Figure 8:
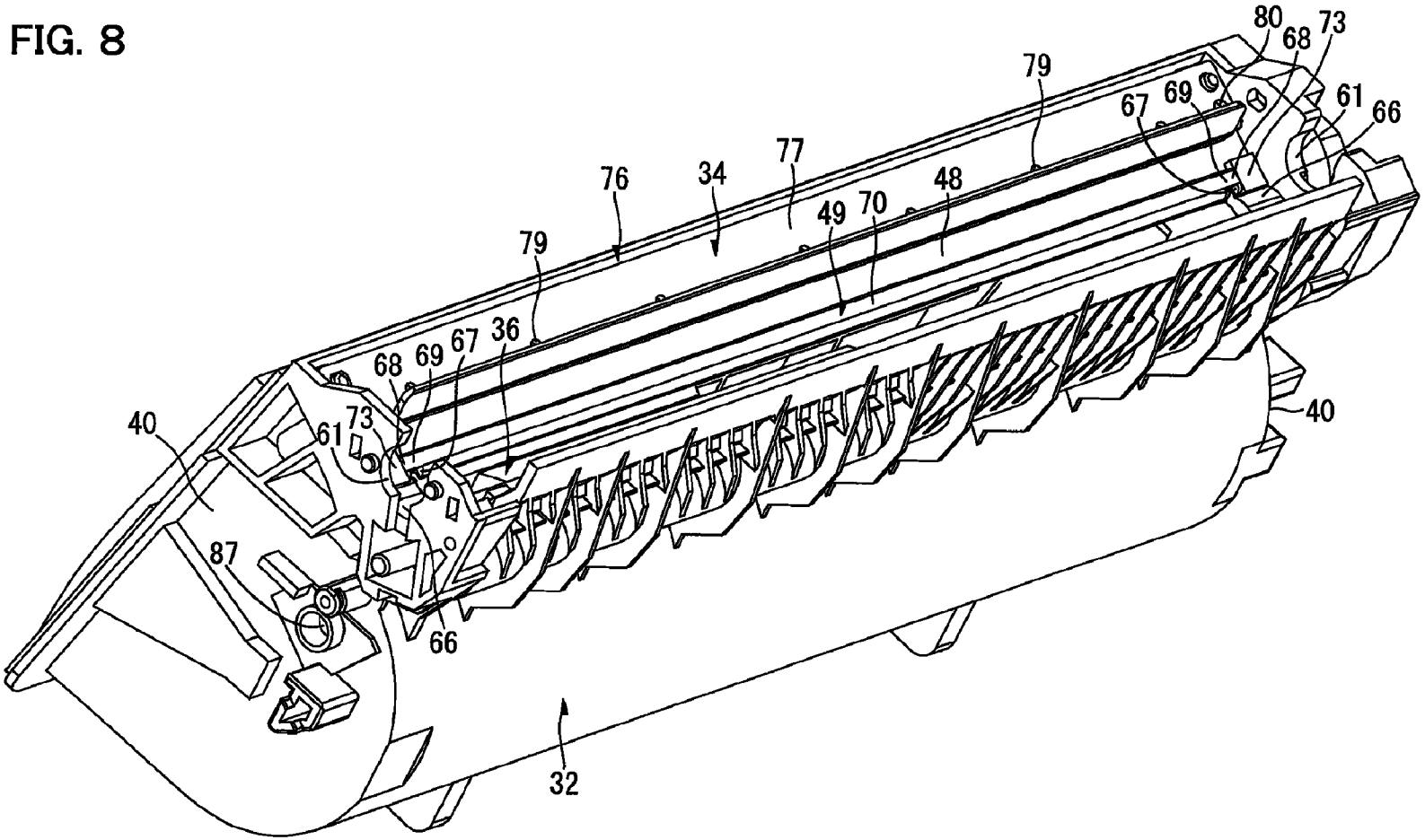
FIG. 8 shows a perspective view of a developer cartridge seen from the rear of a casing according to another embodiment of one or more aspects of the present invention.
Figure 9:
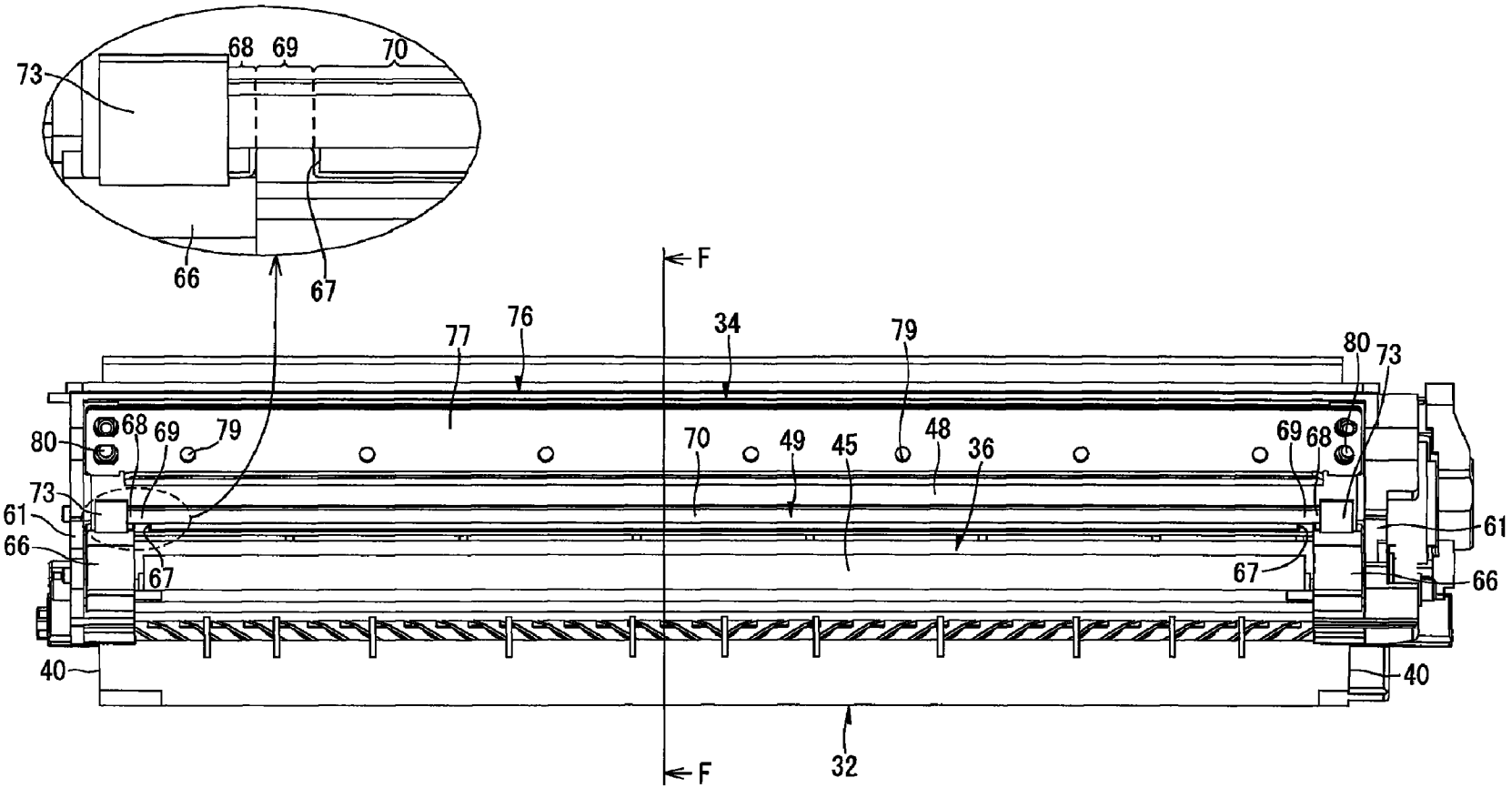
FIG. 9 shows a rear view of the casing shown in FIG. 8.
Figure 10:
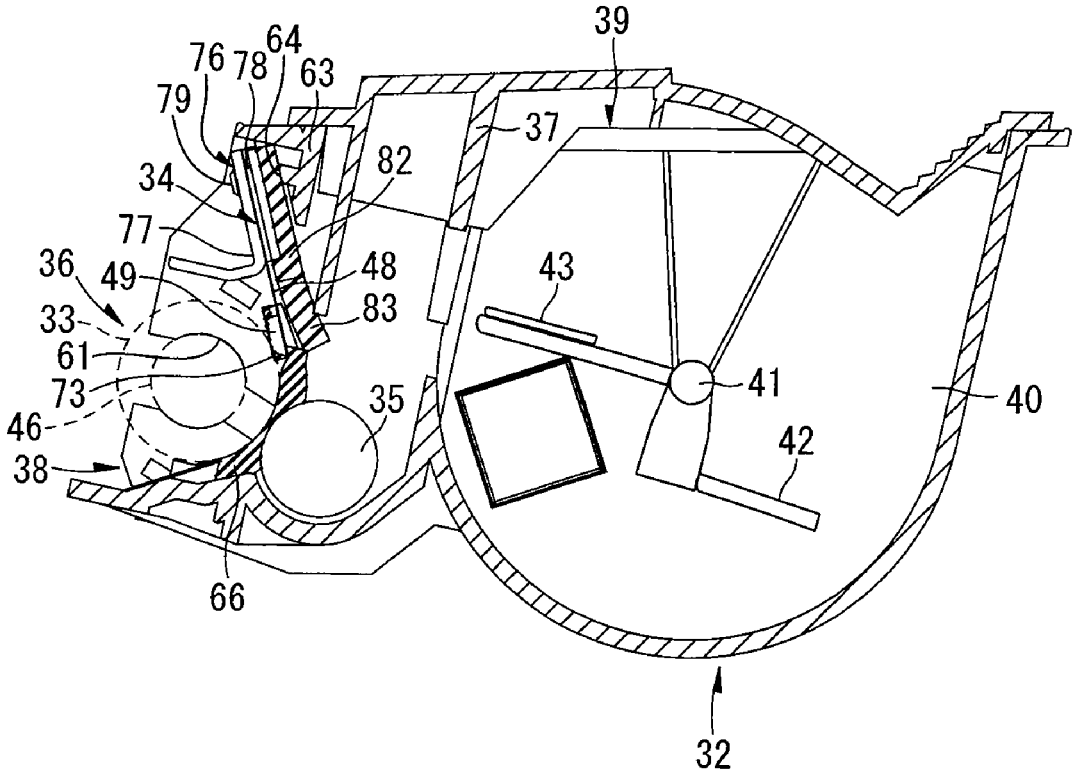
FIG. 10 shows a sectional view taken along the line F-F in FIG. 9.
Figure 11:
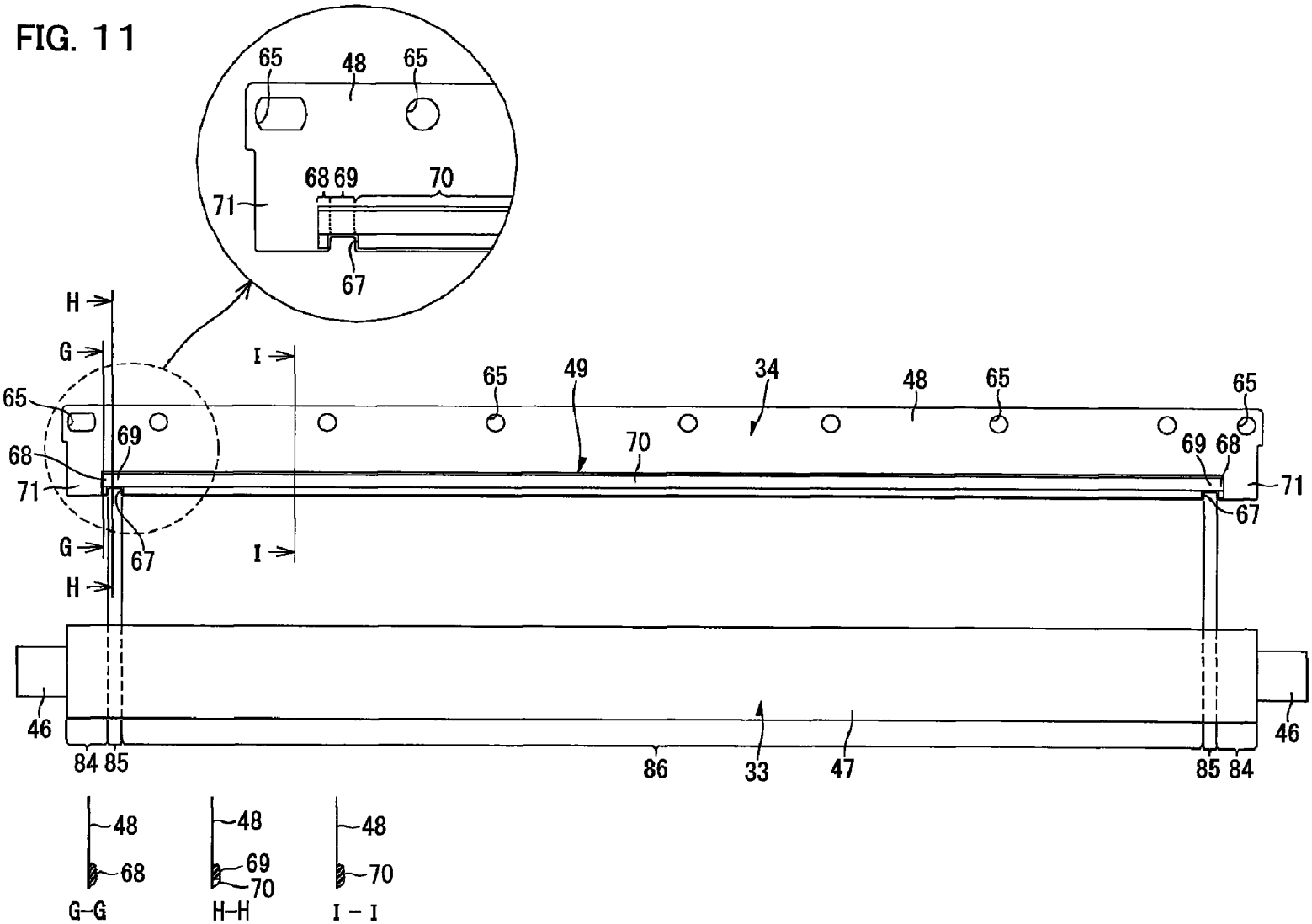
FIG. 11 shows a rear view of a layer-thickness regulating blade shown in FIG. 9.

FIG. 8 shows a perspective view of a developer cartridge seen from the rear of a casing according to another embodiment of one or more aspects of the present invention, FIG. 9 shows a rear view of the casing shown in FIG. 8, FIG. 10 shows a sectional view taken along the line F-F in FIG. 9, and FIG. 11 shows a rear view of a layer-thickness regulating blade shown in FIG. 11. The variations of the developer cartridge 28 will be described in detail with reference to FIGS. 8 through 11. In the following explanation, the same reference numerals are used for members corresponding to those described above, and their descriptions are omitted.

As for the developer cartridge 28 shown in FIGS. 3 through 7, in the layer-thickness regulating blade 34, the first pressure contact portion 68 of the pressure contact portion 49 is provided in the lateral outer portion of the notched portion 67 continuously from the outer end edge of the notched portion 67 in the lower end portion of the leaf-spring member 48 so that the lateral outer end edge portion (lateral sticked portion 71) and the lower end edge portion (lower-side sticked portion 72) of the leaf-spring member 48 are exposed, and the blade seal 73 having a generally L-shape in rear view is provided so that its longitudinal band area 75 is attached to the lateral sticked portion 71 and its lateral band area 74 is attached to the lower-side sticked portion 72. However, the first pressure contact portion 68 and the blade seal 73 can also be provided as follows.

4-1. First Pressure Contact Portion

Specifically, as shown in FIG. 11, the first pressure contact portion 68 is formed in the lateral outer portion of the notched portion 67 continuous from the outer end edge of the notched portion 67 in the lower end portion of the leaf-spring member 48, and extends along the outer end edge of the notched portion 67 with a narrow width, so that most of the lateral outer end edge portion of the leaf-spring member 48 is exposed. Further, the first pressure contact portion 68 is formed such that the sectional shape thereof along the up and down direction is a generally elongated rectangular shape with its corners curved, as shown in the sectional view taken along the line G-G in FIG. 11.

On the lateral outside of the first pressure contact portion 68, the lateral outer end edge portion of the leaf-spring member 48 exposed from the first pressure contact portion 68 is defined as the lateral sticked portion 71 to which the blade seal 73 is attached.

As is the case with the above embodiment, in the pressure contact portion 49, the upper end edges of the first pressure contact portions 68, the second pressure contact portions 69 and the third pressure contact portion 70 are flush with one another.

On the other hand, the respective lower end edges of the first pressure contact portions 68 and the third pressure contact portion 70 are formed continuously with the lower end edge of the leaf-spring member 48. Further, the respective lower end edges of the second pressure contact portions 69 are formed continuously with the upper end edges of the respective notched portions 67 of the leaf-spring member 48. That is, the lower end edges of the respective second pressure contact portions 69 are arranged above the respective lower end edges of the first pressure contact portions 68 and the third pressure contact portion 70. Therefore, as shown in the sectional views taken along the lines G-G, H-H and I-I in FIG. 11, the first pressure contact portions 68 and the third pressure contact portion 70 are formed in the same sectional shape along the up and down direction, but the second pressure contact portions 69 are formed in a different sectional shape along the up and down direction from that of the first and the third pressure contact portions 68, 70.

As is the case with the above embodiment, the pressure contact portion 49 is provided so as to surround each notched portion 67. More specifically, the second pressure contact portion 69 is formed continuously with the upper end edge of the notched portion 67, the first pressure contact portion 68 is formed on the lateral outer end edge of the notched portion 67 continuously from the second pressure contact portion 69 so as to surround the notched portion 67, and the third pressure contact portion 70 is formed on the widthwise inner edge of the notched portion 67 continuously from the second pressure contact portion 69 so as to surround the notched portion 67.

4-2. Blade Seal

As shown in FIGS. 8 and 9, the blade seal 73 is formed in a generally rectangular shape in rear view, and is attached to each of the both lateral end portions of the leaf-spring member 48.

More specifically, in the lateral outer portion (opposed portion of the layer-thickness regulating blade 34 to each seal area 84 of the developing roller 33) from the outer end edge of each notched portion 67 in the leaf-spring member 48, the blade seal 73 is attached to the lateral sticked portion 71 via a double-faced adhesive tape, etc. so as to abut against the widthwise outer end edge of the first pressure contact portion 68 without a gap.

When the layer-thickness regulating blade 34 is attached, as shown in FIG. 10, the blade seal 73 is arranged adjacent to the side seal 66 on the upper side so that the lower end portion of the leaf-spring member 48 is placed on the upper end portion of the side seal 66 at each of the both lateral end portions thereof, and the lower end portion of the blade seal 73 and the upper end portion of the side seal 66 overlap each other in their thickness direction.

4-3. Operations and Effects of Variation

The effects of (1), (2), (4), (6), (10), and (11) described in "3. Operations and Effects of Embodiments" can be obtained in the developer cartridge 28 shown in FIGS. 8 through 11.

(12) Further, in the developer cartridge 28 shown in FIGS. 8 through 11, the blade seal 73 is attached to the lateral sticked portion 71 of the lateral outer portion of the leaf-spring member 48 via a double-faced adhesive tape, etc. so as to abut against the lateral outside end edge of the first pressure contact portion 68 without a gap. Thus, the toner that moves outward in the width direction from the first pressure contact portion 68 can be surely blocked. Therefore, the leakage of the toner from the side end areas 85 of the developing roller 33 can be highly effectively prevented.

That is, since the developer cartridge 28 shown in FIGS. 8 through 11 is also provided with the side seal 66 and the blade seal 73 at each of the both lateral end portions of the opening 36, the side seal 66 prevents the leakage of the toner to the lower side of the lateral outer portion from the outer end edge of the notched portion 67 in the layer-thickness regulating blade 34, and the blade seal 73 prevents the leakage of the toner to the widthwise outer portion from the outer end edge of the notched portion 67 in the layer-thickness regulating blade 34. Therefore, the side seal 66 and the blade seal 73 can surely prevent the leakage of the toner to the axial outside of the developing roller 33.

In the developer cartridge 28 shown in FIGS. 8 through 11, even if the toner enters into the portion between the lateral outer end edge of the first pressing member 68 and the blade seal 73, the path through which the toner leaks can be divided into a path through which the toner moves therebetween along the rotation direction of the developing roller 33, and a path through which the toner moves between the side seal 66 and the blade seal 73. This can effectively suppress the leakage of the toner out of the casing 32.

4-4. Other Variations

The above explanation illustrates the laser printer 1 including the processing unit 19 in which the developer cartridge 28 is detachably attached to the drum cartridge 27, as the image forming apparatus of the present invention. However, the image forming apparatus of the present invention is not limited thereto, and may be, for example, a laser printer including the developer cartridge 28 that is directly attached to and detached from the main body casing 2 provided with the photosensitive drum 29. Furthermore, the image forming apparatus of the present invention is not limited to the aforementioned monochrome laser printer, and may be color laser printers of various types (a four-cycle type, a tandem type employing an intermediate transfer system, a tandem type employing a direct transfer system, etc.).

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. A developing device comprising:

a casing that accommodates a developing agent and has an opening portion formed therein extending in a longitudinal direction;

a developing agent carrier that is rotatably provided in the casing so as to be exposed from the opening portion and carries the developing agent;

a leakage preventing member that is arranged at each of both longitudinal end portions of the casing to prevent the developing agent from leaking out of the casing; and a layer-thickness regulating member that comes into pressure-contact with a surface of the developing agent carrier to form a thin layer of the developing agent on the surface of the developing agent carrier, wherein the developing agent carrier comprises, in a longitudinal direction thereof:

a seal area that is rubbed with the leakage preventing member;

a side end area adjacent to the seal area on a longitudinal inside of the developing agent carrier; and a central area sandwiched between the side end areas, the layer-thickness regulating member comprises:

a thin plate member which is formed in a thin plate-like shape extending along a longitudinal direction of the opening portion, whose downstream end portion of a rotation direction of the developing agent carrier, orthogonal to the longitudinal direction of the opening portion, is fixed to the casing, and whose upstream end portion of the rotation direction of the developing agent carrier is a distal end; and a projection member that is provided at the distal end of the thin plate member and protrudes toward a direction approaching to the developing agent carrier, and the projection member comprises a first pressure contact portion that comes into pressure-contact with the seal area, a second pressure contact portion that comes into pressure-contact with the side end area, and a third pressure contact portion that comes into pressure-contact with the central area, wherein a notched portion is formed at a position of the distal end of the thin plate member where the second pressure contact portion is formed, by cutting the thin plate member from an end edge of the distal end toward a downstream side of the rotation direction of the developing agent carrier.

2. The developing device according to claim 1, wherein the second pressure contact portion is provided at least at an end edge of the deepest portion of the notched portion, and the first pressure contact portions is provided at a longitudinal outer end edge of the notched portion so as to be continuous with the second pressure contact portion to surround at least the notched portion.

3. The developing device according to claim 1, wherein the first pressure contact portion is formed such that the end edge of the distal end is exposed, the second pressure contact portion is formed such that a length thereof along the rotation direction of the developing agent carrier is shorter than a length of the first pressure contact portion along the rotation direction of the developing agent carrier, and the third pressure contact portion is formed such that a length thereof along the rotation direction of the developing agent carrier is longer than the length of the first pressure contact portion along the rotation direction of the developing agent carrier.

4. The developing device according to claim 1, wherein the first pressure contact portion, the second pressure contact portion, and the third pressure contact portion are formed continuously along the longitudinal direction, and the sectional shape of the second pressure contact portion along the rotation direction of the developing agent carrier is different from the respective sectional shapes of the first pressure contact portion and the third pressure contact portion along the rotation direction of the developing agent carrier.

5. The developing device according to claim 4, wherein the sectional shape of the first pressure contact portion along the rotation direction of the developing agent carrier is different from the sectional shape of the third pressure contact portion along the rotation direction of the developing agent carrier.

6. The developing device according to claim 1, wherein the notched portion is formed in a recessed shape such that an upstream side of the rotation direction of the developing agent carrier is open.

7. The developing device according to claim 1, wherein the thin plate member comprises:

a side end exposing area that is exposed from the first pressure contact portion, on a longitudinal outside with respect to the first pressure contact portion; and an upstream end exposing area that is exposed from the first pressure contact portion, on an upstream side of the rotation direction of the developing agent carrier with respect to the first pressure contact portion, and the leakage preventing member is arranged in the side end exposing area and the upstream end exposing area so as to abut against the first pressure contact portion.

8. The developing device according to claim 7, wherein the leakage preventing member comprises:

a first seal member arranged on the upstream side of the rotation direction of the developing agent carrier so as to be adjacent to an opposed portion of the layer-thickness regulating member to the seal area; and a second seal member arranged in the side end exposing area and the upstream end exposing area so as to abut against the first pressure contact portion and arranged adjacent to the first seal member, in the opposed portion of the layer-thickness regulating member to the seal area.

9. The developing device according to claim 8, wherein the second seal member abuts against the first pressure contact portion throughout an entire longitudinal width thereof.

10. The developing device according to claim 8, wherein a downstream end portion of the rotation direction of the developing agent carrier in the first seal member and an upstream end portion of the rotation direction of the developing agent carrier in the second seal member overlap each other in their thickness direction.

11. The developing device according to claim 1, wherein the leakage preventing member comprises:

a first seal member arranged on the upstream side of the rotation direction of the developing agent carrier so as to be adjacent to an opposed portion of the layer-thickness regulating member to the seal area; and a second seal member arranged in the opposed portion of the layer-thickness regulating member to the seal area so as to be adjacent to the first seal member.

12. The developing device according to claim 11, wherein a downstream end portion of the rotation direction of the developing agent carrier in the first seal member and an upstream end portion of the rotation direction of the developing agent carrier in the second seal member overlap each other in their thickness direction.

13. An image carrier device comprising:

a developing device; and an image carrier that carries a developing agent image formed by feeding a developing agent from the developing device and then developing an electrostatic latent image, wherein the developing device comprises:

a casing that accommodates a developing agent and has an opening portion formed therein extending in a longitudinal direction;

a developing agent carrier that is rotatably provided in the casing so as to be exposed from the opening portion and carries the developing agent;

a leakage preventing member that is arranged at each of both longitudinal end portions of the casing to prevent the developing agent from leaking out of the casing; and a layer-thickness regulating member that comes into pressure-contact with a surface of the developing agent carrier to form a thin layer of the developing agent on the surface of the developing agent carrier, the developing agent carrier comprises, in a longitudinal direction thereof;

a seal area that is rubbed with the leakage preventing member;

a side end area adjacent to the seal area on a longitudinal inside of the developing agent carrier; and a central area sandwiched between the side end areas, the layer-thickness regulating member comprises:

a thin plate member which is formed in a thin plate-like shape extending along a longitudinal direction of the opening portion, whose downstream end portion of a rotation direction of the developing agent carrier, orthogonal to the longitudinal direction of the opening portion, is fixed to the casing, and whose upstream end portion of the rotation direction of the developing agent carrier is a distal end; and a projection member that is provided at the distal end of the thin plate member and protrudes toward a direction approaching to the developing agent carrier, and the projection member comprises a first pressure contact portion that comes into pressure-contact with the seal area, a second pressure contact portion that comes into pressure-contact with the side end area, and a third pressure contact portion that comes into pressure-contact with the central area, wherein a notched portion is formed at a position of the distal end of the thin plate member where the second pressure contact portion is formed, by cutting the thin plate member from an end edge of the distal end toward a downstream side of the rotation direction of the developing agent carrier.

14. An image forming apparatus comprising:

an image carrier device comprising a developing device, and an image carrier that carries a developing agent image formed by feeding a developing agent from the developing device and then developing an electrostatic latent image; and a fixing unit for fixing the developing agent image onto a recording medium, wherein the developing device comprises:

a casing that accommodates a developing agent and has an opening portion formed therein extending in a longitudinal direction;

a developing agent carrier that is rotatably provided in the casing so as to be exposed from the opening portion and carries the developing agent;

a leakage preventing member that is arranged at each of both longitudinal end portions of the casing to prevent the developing agent from leaking out of the casing; and a layer-thickness regulating member that comes into pressure-contact with a surface of the developing agent carrier to form a thin layer of the developing agent on the surface of the developing agent carrier, the developing agent carrier comprises, in a longitudinal direction thereof;

a seal area that is rubbed with the leakage preventing member;

a side end area adjacent to the seal area on a longitudinal inside of the developing agent carrier; and a central area sandwiched between the side end areas, the layer-thickness regulating member comprises:

a thin plate member which is formed in a thin plate-like shape extending along a longitudinal direction of the opening portion, whose downstream end portion of a rotation direction of the developing agent carrier, orthogonal to the longitudinal direction of the opening portion, is fixed to the casing, and whose upstream end portion of the rotation direction of the developing agent carrier is a distal end; and a projection member that is provided at the distal end of the thin plate member and protrudes toward a direction approaching to the developing agent carrier, and the projection member comprises a first pressure contact portion that comes into pressure-contact with the seal area, a second pressure contact portion that comes into pressure-contact with the side end area, and a third pressure contact portion that comes into pressure-contact with the central area, wherein a notched portion is formed at a position of the distal end of the thin plate member where the second pressure contact portion is formed, by cutting the thin plate member from an end edge of the distal end toward a downstream side of the rotation direction of the developing agent carrier.

15. An image forming apparatus comprising:

a developing device;

an image carrier that carries a developing agent image formed by feeding a developing agent from the developing device and then developing an electrostatic latent image; and a fixing unit for fixing the developing agent image onto a recording medium, wherein the developing device comprises:

a casing that accommodates a developing agent and has an opening portion formed therein extending in a longitudinal direction;

a developing agent carrier that is rotatably provided in the casing so as to be exposed from the opening portion and carries the developing agent;

a leakage preventing member that is arranged at each of both longitudinal end portions of the casing to prevent the developing agent from leaking out of the casing; and a layer-thickness regulating member that comes into pressure-contact with a surface of the developing agent carrier to form a thin layer of the developing agent on the surface of the developing agent carrier, the developing agent carrier comprises, in a longitudinal direction thereof;

a seal area that is rubbed with the leakage preventing member;

a side end area adjacent to the seal area on a longitudinal inside of the developing agent carrier; and a central area sandwiched between the side end areas, the layer-thickness regulating member comprises:

a thin plate member which is formed in a thin plate-like shape extending along a longitudinal direction of the opening portion, whose downstream end portion of a rotation direction of the developing agent carrier, orthogonal to the longitudinal direction of the opening portion, is fixed to the casing, and whose upstream end portion of the rotation direction of the developing agent carrier is a distal end; and a projection member that is provided at the distal end of the thin plate member and protrudes toward a direction approaching to the developing agent carrier, and the projection member comprises a first pressure contact portion that comes into pressure-contact with the seal area, a second pressure contact portion that comes into pressure-contact with the side end area, and a third pressure contact portion that comes into pressure-contact with the central area, wherein a notched portion is formed at a position of the distal end of the thin plate member where the second pressure contact portion is formed, by cutting the thin plate member from an end edge of the distal end toward a downstream side of the rotation direction of the developing agent carrier.

* * * * *